US010301812B1

(12) United States Patent
Mazza

(10) Patent No.: US 10,301,812 B1
(45) Date of Patent: May 28, 2019

(54) MODULAR HOME BAR APPARATUS

(71) Applicant: Christtian Mazza, Mazza, PA (US)

(72) Inventor: Christtian Mazza, Mazza, PA (US)

( * ) Notice: Subject to any disclaimer, the term of this patent is extended or adjusted under 35 U.S.C. 154(b) by 0 days.

(21) Appl. No.: 15/991,918

(22) Filed: May 29, 2018

(51) Int. Cl.
*A47B 69/00* (2006.01)
*E04B 1/343* (2006.01)
*E04B 1/348* (2006.01)

(52) U.S. Cl.
CPC ..... *E04B 1/34807* (2013.01); *E04B 1/34331* (2013.01); *A47B 69/00* (2013.01)

(58) Field of Classification Search
CPC . E04B 1/34807; E04B 1/34331; A47B 69/00; A47B 73/00; A47B 73/006
See application file for complete search history.

(56) References Cited

U.S. PATENT DOCUMENTS 1,913,387 A * 6/1933 Hayward ..... A47B 69/00 312/140.2
2,260,586 A * 10/1941 Sheldon ..... A47B 69/00 144/285
2,661,258 A * 12/1953 Dinken ..... A47B 69/00 108/79
3,672,741 A * 6/1972 Clark ..... A47B 49/00 312/140.2
3,841,728 A * 10/1974 Petersen ..... A47B 43/00 108/159
3,848,375 A * 11/1974 White ..... A47B 43/00 312/140.2
3,936,106 A * 2/1976 Harper ..... A47B 69/00 312/107
3,983,583 A * 10/1976 Herman ..... A47B 69/00 62/331
3,985,410 A * 10/1976 Young ..... A47B 51/00 312/306
D306,664 S * 3/1990 Pouch ..... 312/140.2
5,184,886 A * 2/1993 Handley ..... A47B 69/00 312/107
5,382,087 A * 1/1995 Pouch ..... A47B 43/00 160/135
7,354,120 B2 * 4/2008 DeMars ..... A47F 9/00 126/25 R
2004/0090156 A1 * 5/2004 Kunanantakul ..... A47B 47/025 312/257.1
2006/0238083 A1 * 10/2006 DeMars ..... A47F 9/00 312/140.2
2014/0306584 A1 * 10/2014 DeMars ..... A47F 9/00 312/140.2
2017/0156499 A1 * 6/2017 Kane ..... A47B 96/20
2018/0070718 A1 * 3/2018 Insinna ..... A47B 3/06

* cited by examiner

*Primary Examiner* — Rodney Mintz
(74) *Attorney, Agent, or Firm* — Axenfeld Law Group, LLC; Robert R. Axenfeld; Vik Patel

(57) ABSTRACT

Described is a modular home bar apparatus that allows for easy home installation and removal. The modular home bar apparatus includes a frame, an L-shaped or U-shaped unit, and optional shelving or ceiling units. The frame can be installed against a wall or as a floating unit in the room. The L-shaped or U-shaped unit covers the top of the frame and at least one side of the frame, providing both stability for the home bar apparatus and a place to mix drinks.

16 Claims, 7 Drawing Sheets

MODULAR HOME BAR APPARATUS

BACKGROUND

Many homeowners desire to have a bar located in a room of their house as an accent piece that helps to divide up an area of an ordinary room, and act as focal point for entertainment, parties, and a place to make and enjoy drinks.

Professional installation of a home bar can be expensive and require the services of a contractor. The installation of a permanent-bar fixture makes subsequent modifications difficult.

On the other hand, home bars that aren't installed look more like furniture than a fixture in a room, and often lack the sturdiness and appearance of a professionally-installed bar.

SUMMARY

Described in this paper is a modular home bar apparatus that addresses many of the deficiencies discussed above.

In one embodiment, the home bar apparatus includes a frame and an L-shaped unit.

The frame includes a horizontal-top beam, an opposing bottom beam, and two vertical-side beams opposite each other that are attached to the horizontal-top beam and bottom beam to form the four sides of a square or rectangle.

The L-shaped unit, in one embodiment, includes two pieces, a top panel and a side panel. The L-shaped unit fits around the frame. That is, the top panel has a bottom surface that fits over and is adjacent to the horizontal-top beam. The side panel has an inner surface that fits around and is adjacent to the vertical-side beam. The inner surface of the side panel is also parallel to the wall. A distal end of the top panel furthest from the side panel is configured to rest against the wall. A proximal end of the top panel is also attached to the side panel and forms about a ninety-degree angle with the side panel. The side panel has an end furthest from the top panel, and is configured to rest upon the floor.

Thus, the top panel and the side panel form an 'L' shape. The L-shaped unit may be secured to the horizontal-top beam and the vertical-side beam opposite the wall. The L-shaped unit has a depth beyond that of the frame, which creates a T-shaped cross section against both the wall and the floor, and provides additional stability. The top panel of the L-shaped unit has a top surface, which also acts as a countertop or serving area of the bar.

The apparatus may include additional components such as a front fascia to cover the front of the frame, a shelving unit secured to the back of the frame, a second shelving unit secured to a wall, or a ceiling unit secured to the ceiling. The ceiling unit may incorporate the same frame and L-shaped unit(s) described above with the L-shaped unit(s) forming an outer boundary of the ceiling unit.

The front fascia attaches to the front of the frame, and more specifically to one or more of the horizontal-top, horizontal-bottom or side-vertical beams comprising the frame. A strip or multiple strips may be use to cover the attachment hardware used to connect the front fascia to the front of the frame. That is, each strip is configured such that when it is attached to the frame, each strip may cover (i.e., hide) the implements, such as screws, used to connect the front fascia to the front of the frame.

In another embodiment, the bar apparatus may also reside as a standalone unit without touching a wall. In such an implementation the L-shaped unit is replaced with a U-shaped unit with a top panel and two vertical-side panels.

The top panel has a bottom surface that fits over and is adjacent to the horizontal-top beam. Each side panel has an inner surface that fits around and is adjacent to each of the vertical-side beams. The inner surface of each the side panels are also parallel to each other. One end of the top panel is also attached to one of the side panels and forms about a ninety-degree angle with that side panel. The opposing end of the top panel is attached to the other side panel and forms about a ninety-degree angle with that side panel. When installed as a standalone unit, the frame can be secured to the floor, but not to a wall.

This summary is provided to introduce a selection of concepts in a simplified form that are further described below. This summary is not necessarily intended to identify key features or essential features of the claimed subject matter, nor is it necessarily intended to be used as an aid in determining the scope of the claimed subject matter.

The foregoing outlines examples of this disclosure so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

Reference herein to "one embodiment," "an embodiment," "an aspect," "an implementation," "an example," or similar formulations, means that a particular feature, structure, operation, or characteristic described in connection with the embodiment is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

DETAILED DESCRIPTION

Described is a modular home bar apparatus that allows a homeowner to easily install or remove a home bar. Some embodiments of the home bar apparatus may be described with reference to FIGS. 1 through 12.

Figure 1:
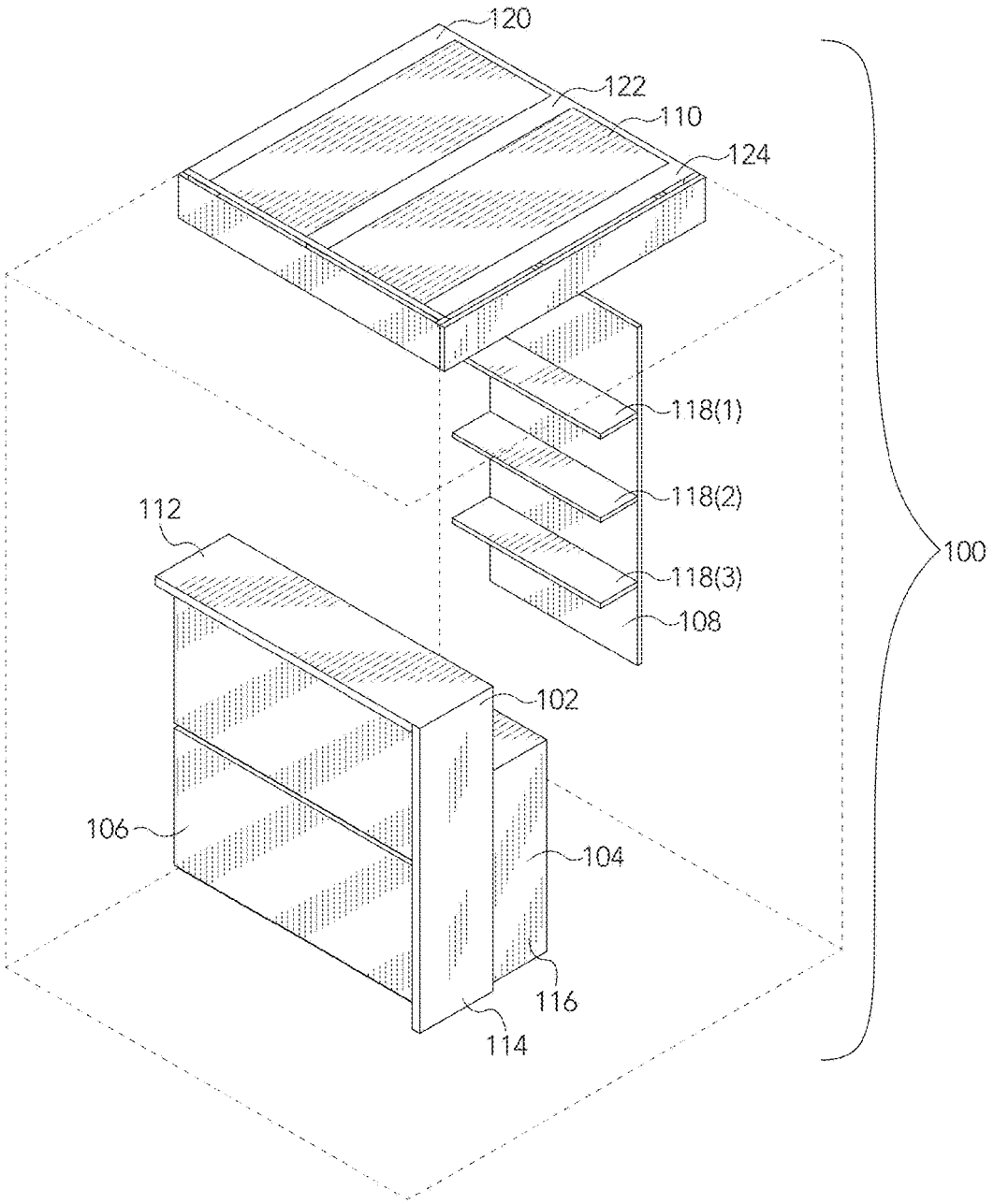
FIG. 1 shows a top front perspective view of an embodiment of a modular home bar apparatus including the L-shaped unit, frame-shelving unit, front fascia, wall-shelving unit, and ceiling unit.

FIG. 1 shows a top front isometric view of an embodiment of the home bar apparatus 100 including an L-shaped unit 102, frame-shelving unit 104, front fascia 106, wall-shelving unit 108, and ceiling unit 110.

Frame

Figure 2:
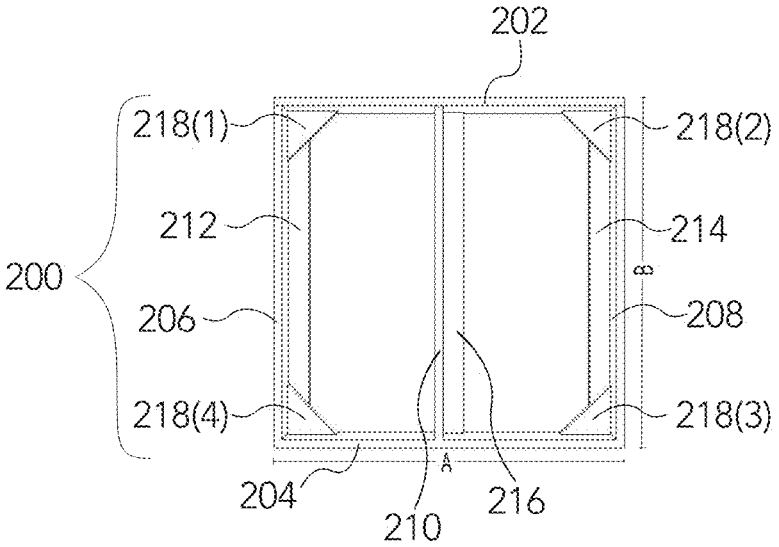
FIG. 2 shows a front view of the frame from an embodiment of a modular home bar apparatus.

Turning to FIG. 2, frame 200 is shown as having approximately a rectangular cuboid shape. Frame 200 includes a horizontal-top beam 202, an opposing bottom beam 204, a left-vertical beam 206, and a right-vertical beam 208. Beam 206 and beam 208 oppose each other and are attached at distal ends to beam 202 and beam 204. Beam 202, beam 204, beam 206, and beam 208 form the four sides of a square.

Frame 200 further includes a vertical-central beam 210 located midway between beam 206 and beam 208 that is parallel to beam 206 and beam 208. Beam 210 is attached at distal ends to beam 202 and beam 204. Beam 210 is perpendicular to beam 202 and beams 204.

Frame 200 is also shown as including three vertical-support beams: beam 212, beam 214, and beam 216. Beam 212, beam 214, and beam 216 are all located in the plane perpendicular to both beam 202 and beam 206. Beam 212, beam 214, and beam 216 are each attached at distal ends to beam 202 and beam 204. An edge of beam 212 is attached to an edge of beam 206 to form a ninety-degree angle. Similarly, an edge of beam 214 is attached to an edge of beam 208 to form a ninety-degree angle and an edge of beam 216 is attached to an edge of beam 210 to also form a ninety-degree angle.

Beam 202, beam 204, beam 206, beam 208, beam 210, beam 212, beam 214, and beam 216 can be secured to each other by various means including but not limited to screws, nuts and bolts, adhesive putty, or any combination thereof.

The inside of frame 200 is shown as including four corner supports 218. Supports 218(1), 218(2), 218(3), 218(4) each have a triangular shape and are located at the points where beam 206 abuts beam 202 and beam 204 and where beam 208 abuts beam 202 and beam 204. The sides of supports 218(1), 218(2), 218(3), 218(4) that form a ninety-degree angle are each about three inches long. Supports 218(1), 218(2), 218(3), 218(4) provide structural support for frame 200. However, as appreciated by those skilled in the art after having the benefit of this disclosure, frame 200 can have several different internal structures as long as the internal structure allows it to support the weight of unit 102 and any bar items, such as glasses, placed on top of unit 102.

Figure 3:
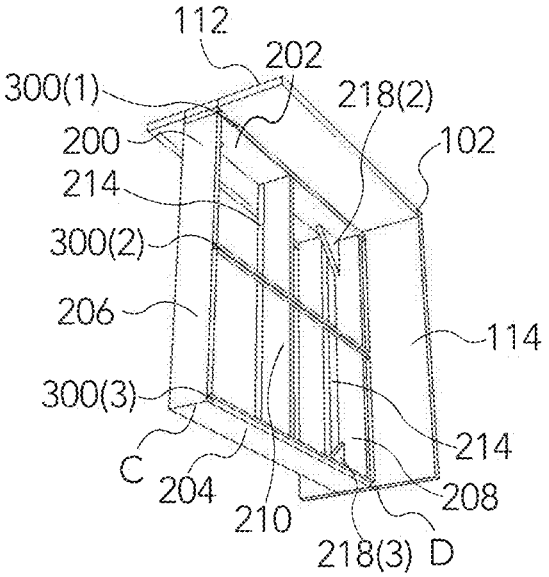
FIG. 3 shows a bottom front perspective view of a frame and L-shaped unit from an embodiment of a modular home bar apparatus.

In the illustrated embodiment, distance A, the distance between the outer edge of beam 206 and the outer edge of beam 208, is about three and a half feet. Distance B, the distance between the outer edge of beam 202 and the outer edge of beam 204, is also about three and a half feet. The distance from the inner edge of beam 202 to the outer edge of beam 202 is about one inch. The distance from the inner edge to the outer edge of beam 204, beam 206, and beam 208 each is also about one inch. In FIG. 3, distance C, the distance from the front edge of beam 206 to the rear edge of beam 206, is about five and a half inches. The distances from the front edge and rear edge of beam 202, beam 204, and Beam 208 are all also about five and a half inches.

FIG. 3 shows that frame 200 may also include a set of horizontal-front beams, also referred to as spacer beams 300(1), 300(2), 300(3), located on a plane perpendicular to beam 202 and beam 206. Each of the spacer beams (generally referred to as reference 300) are parallel with beam 202 and are attached at distal ends to beam 206 and beam 208. In one embodiment, each of the spacer beams 300 have a length of approximately distance A or about three and a half feet in the illustrated example. Spacer beams 300 have a width of approximately one to two inches and a depth of approximately one to two inches.

Figure 4:
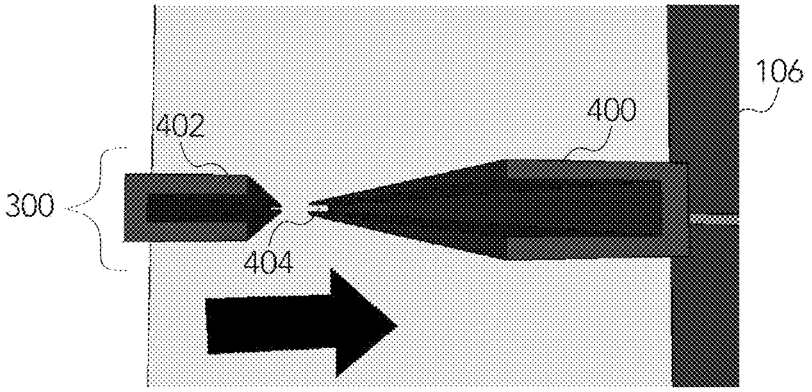
FIG. 4 shows a perspective view of the components of a spacer beam.
Figure 5:
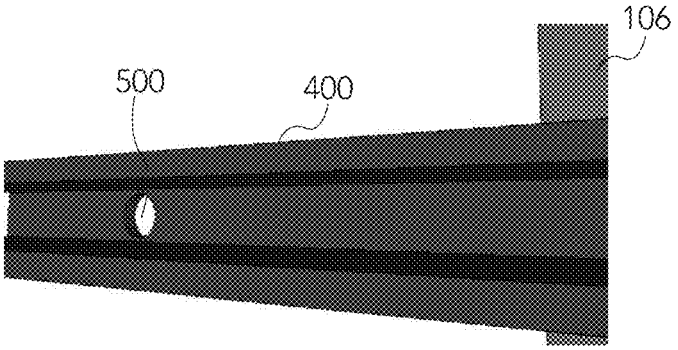
FIG. 5 shows a perspective view of a connection point on a spacer beam.

As shown in FIG. 4, each spacer beam 300 includes two pieces: a securing piece 400 and a cover 402. Piece 400 and cover 402 each have a length about equal to distance A and each has a 'U' shaped cross-section. The 'U' shaped opening 404 of piece 400 is about the size of cover 402 such that cover 402 can be placed inside opening 404. Piece 400 can be secured to frame 200 in several ways including by drilling screws into beam 206, beam 208, and beam 210 through holes in piece 400 such as hole 500 illustrated in FIG. 5. Cover 402 can then be placed inside opening 404 so as to cover the connection points between piece 400 and frame 200.

Figure 6:
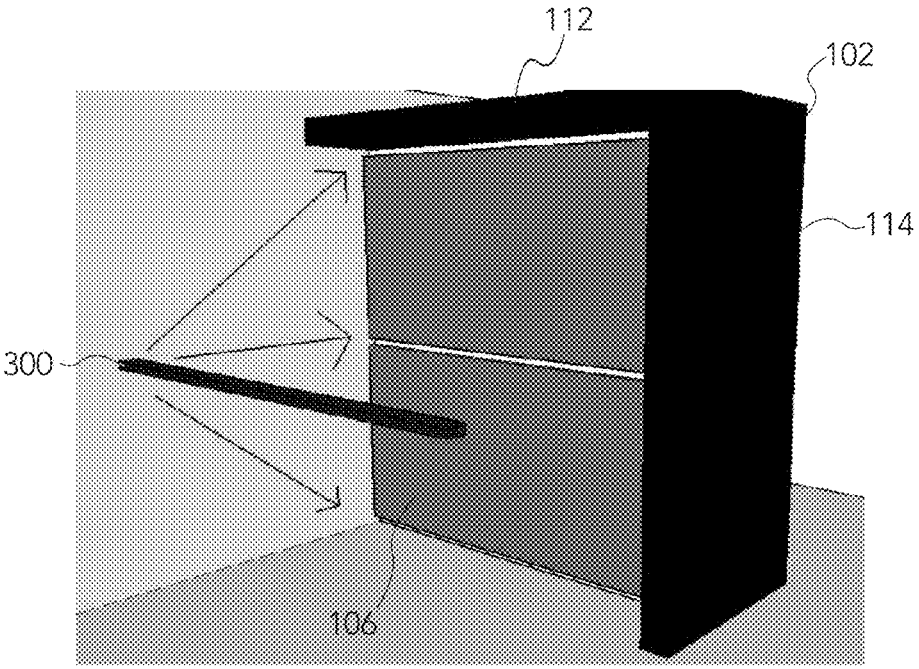
FIG. 6 shows a front perspective view of an embodiment of a modular home bar apparatus demonstrating the placements of spacer beams.

When spacer beams 300 are attached to frame 200, spacer beams 300 can cover the connection points for modular components attached to frame 200, such as fascia 106 as shown in FIG. 6.

A homeowner can secure frame 200 to the floor, the wall, or both. Frame 200 can be secured to the wall or floor by various means including but not limited to drywall anchors, self-tapping screws, adhesive putty, or any combination thereof.

Frame 200 can be composed of any lightweight hard material such as aluminum, plastic, wood, or any combination thereof.

L-Shaped Unit

As shown in FIG. 3, L-shaped unit 102 has a top panel 112 configured to fit coextensively along beam 202 and a side panel 114 configured at about a ninety-degree angle from panel 112 to fit coextensively along beam 208. One end of panel 112 abuts the wall. The opposite end of panel 112 abuts panel 114 to form a ninety-degree angle. The end of panel 114 opposite panel 112 abuts the floor.

The distance from the wall to the outer edge of panel 114 is about three feet and seven inches. The distance from the floor to the outer edge of panel 112 is also about three feet and seven inches. The distance from the front edge of panel 114 to the rear edge of panel 114, distance D, is about eighteen inches. The distance from the front edge of panel 112 to the rear edge of panel 112 is also about eighteen inches.

Figure 7:
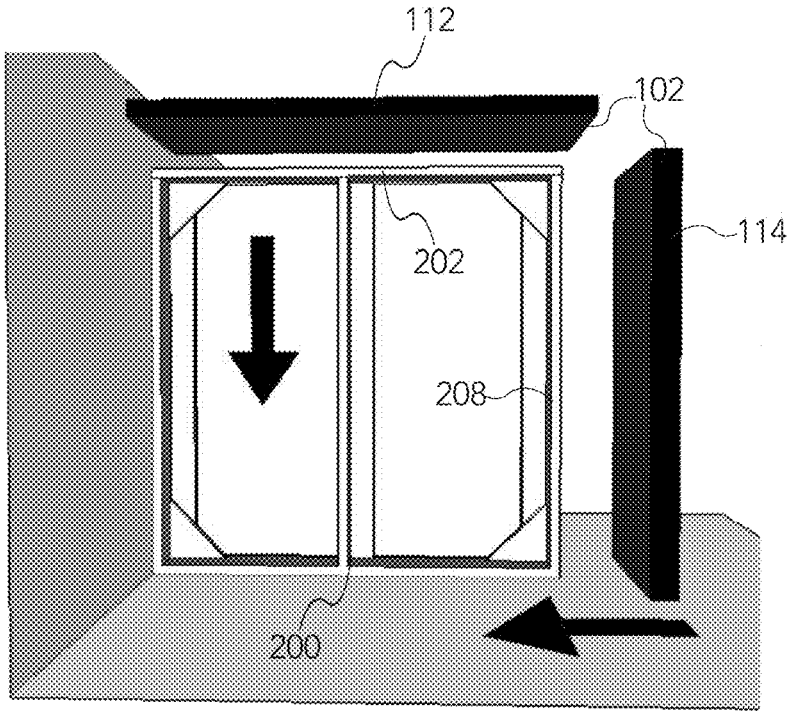
FIG. 7 shows a front view of an embodiment of a modular home bar apparatus and how an L-shaped unit connects to a frame.

Unit 102 can be secured to the top and side of frame 200 by various means including but not limited to nuts and bolts, butterfly locks, magnets, or any combination thereof. FIG. 7 demonstrates that panel 112 and panel 114 need not be attached to each other before being secured to frame 200.

Unit 102 can be composed of any lightweight hard material such as aluminum, plastic, wood, or any combination thereof. It can also have a water resistant or waterproof coating allowing for easy cleaning of unit 102.

Front Fascia

Returning to FIG. 1, apparatus 100 includes a front fascia 106 coupled to the front of frame 200 between beam 206 and beam 208. Fascia 106 is about perpendicular to the ground surface. Fascia 106 has a size and shape that fills the front area of frame 200.

Figure 8:
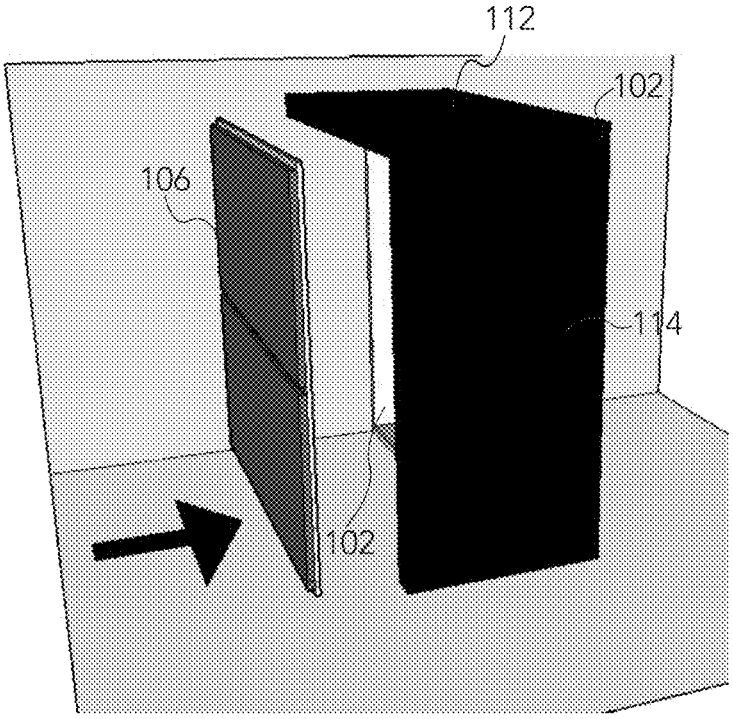
FIG. 8 shows a top front perspective view of an embodiment of a modular home bar apparatus and how a front fascia connects to a frame.

FIG. 8 shows that fascia 106 can be coupled to frame 200 after unit 102 has been secured to frame 200. This means that the floor, the wall, panel 112, and panel 114 surround the four outer edges of fascia 106. Fascia 106 can be coupled to frame 200 by various means including but not limited to nuts and bolts, butterfly locks, magnets, or any combination thereof. As discussed earlier, spacer beams 300 can be used to cover the connection points between frame 200 and fascia 106.

Front fascia 106 can be composed of any lightweight hard material such as aluminum, plastic, wood, or any combination thereof.

Frame-Shelving Unit

Figure 9:
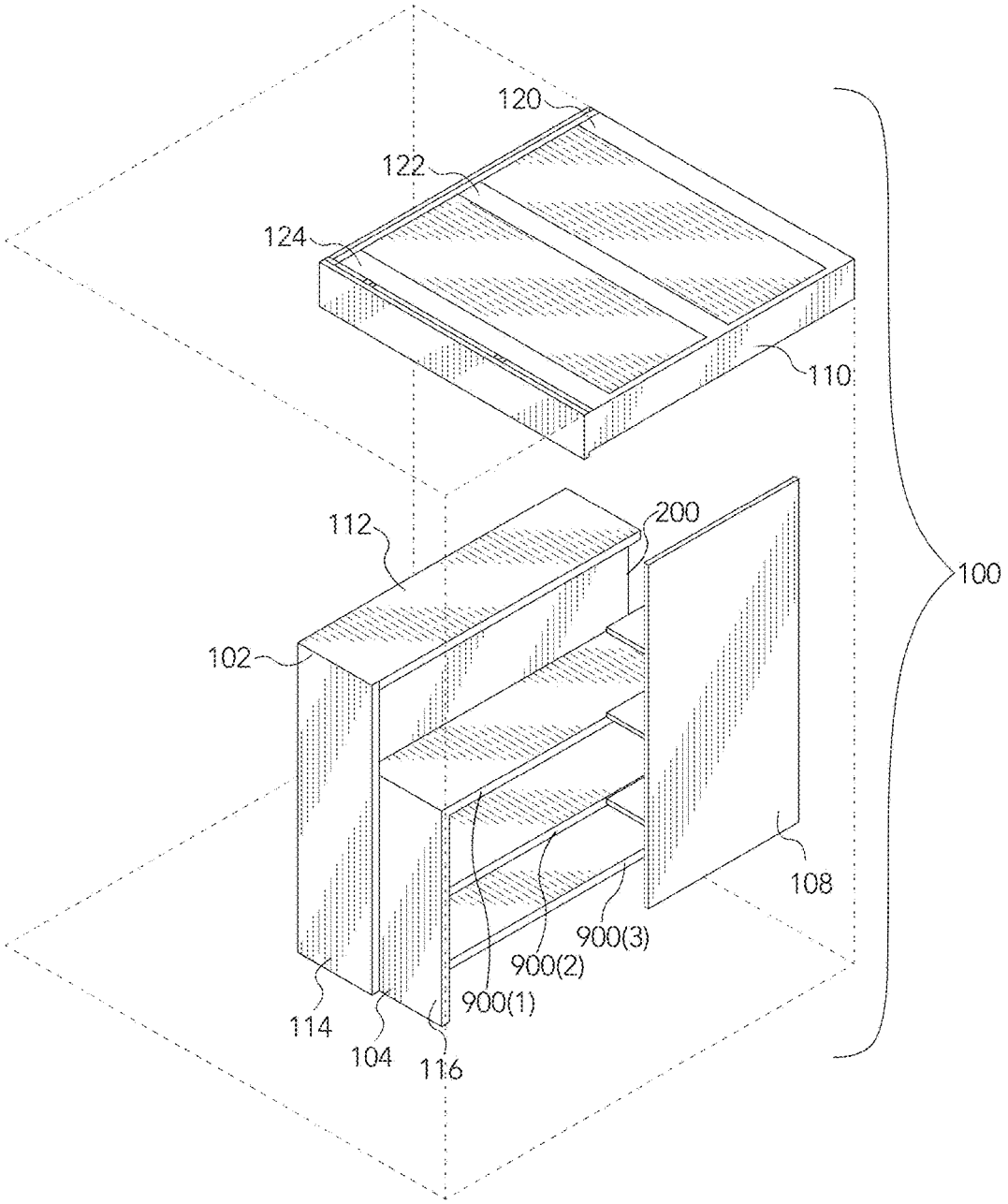
FIG. 9 shows a top rear perspective view of an embodiment of a modular home bar apparatus.

In the embodiment shown in FIG. 9, apparatus 100 includes a frame-shelving unit 104 that can be coupled to the rear of frame 200. Unit 104 adds to the storage space of apparatus 100 by adding shelving space to frame 200.

Unit 104 is shown as having legs 116, but it need not have legs if the shelves 900(1), 900(2), 900(3) are coupled directly to frame 200. Unit 104 can be secured to beam 210, beam 212, and beam 214 (not visible in FIG. 9) in order to couple unit 104 to frame 200. Unit 104 can be coupled to frame 200 by various means including but not limited to nuts and bolts, butterfly locks, magnets, or any combination thereof. FIG. 9 shows unit 104 as having three shelves 900(1), 900(2), 900(3), but unit 104 can have any number of shelves that can fit behind frame 200. As appreciated by those skilled in the art having the benefit of this disclosure, shelves 900 can also take any shape that will fit behind frame 200 and will allow items to be placed upon them.

Unit 104 can be composed of any lightweight hard material such as aluminum, plastic, wood, or any combination thereof.

Wall-Shelving Unit

Once again returning to FIG. 1, apparatus 100 is shown including a wall-shelving unit 108. Unit 108 adds to the storage space of apparatus 100 by adding shelving space on the wall behind frame 200. Unit 108 is shown with several shelves 118(1), 118(2), 118(3), but it can also include other bar accessories (not shown).

Unit 108 can be secured to the wall at any point behind frame 200. Unit 108 can be secured to the wall by various means including but not limited to drywall anchors, self-tapping screws, adhesive putty, or any combination thereof.

Unit 108 can be composed of any lightweight hard material such as aluminum, plastic, wood, or any combination thereof.

Ceiling Unit

Also in FIG. 1, a second frame similar in size and shape to frame 200 that can be secured to the ceiling and act as a ceiling unit 110. Unit 110 includes three support beams: beam 120, beam 122, and beam 124. Beam 120, beam 122, and beam 124 correspond to beam 212, beam 216, and beam 214 of frame 200 accordingly.

Figure 10:
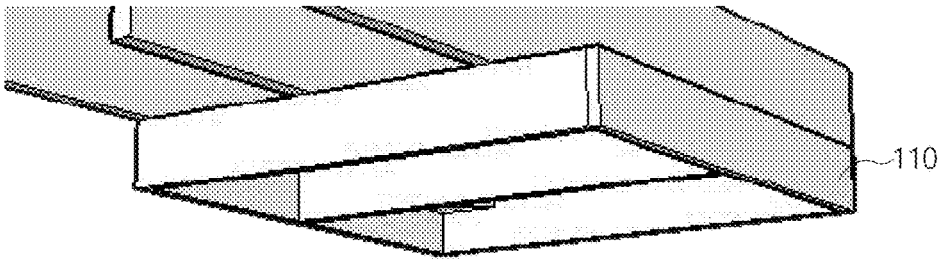
FIG. 10 shows a bottom front perspective view of a ceiling unit secured to ceiling beams from an embodiment of a modular home bar apparatus.
Figure 11:
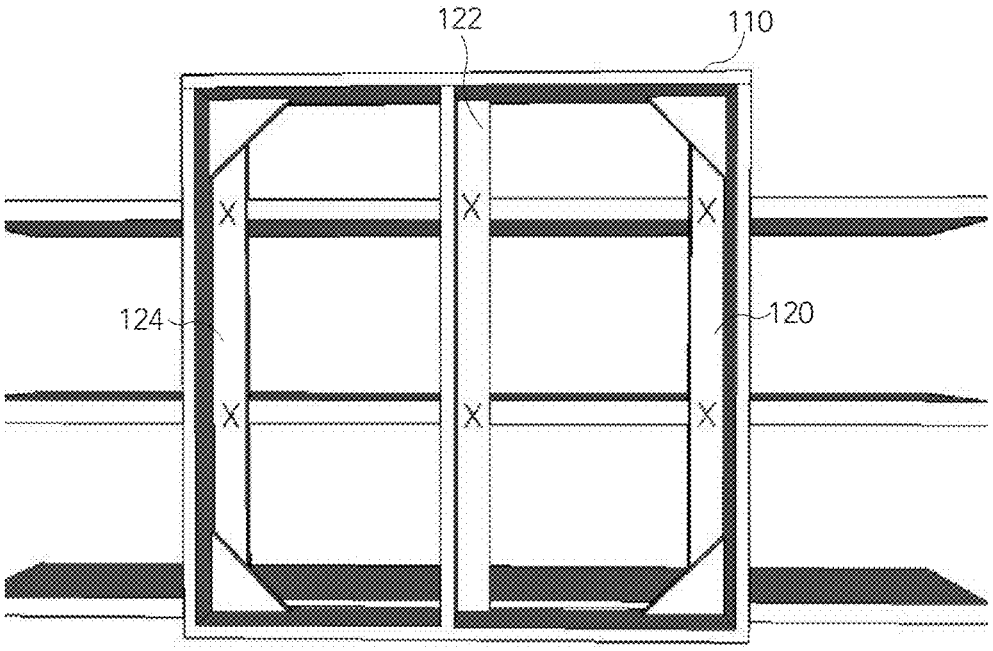
FIG. 11 shows a bottom view of a ceiling unit secured to ceiling beams from an embodiment of a modular home bar apparatus.

Ceiling unit 110 can be secured to a ceiling in several ways. For example, FIG. 10 shows ceiling unit secured to a ceiling that has exposed ceiling beams. FIG. 11 shows that ceiling unit 110 can be secured to such a ceiling by drilling screws into the ceiling through beam 120, beam 122, and beam 124 at the points indicated by 'X's in the illustration.

Panels can be secured to any of the sides of unit 110 in order to cover them. Bar accessories (not shown), such as a wine glass rack, can be installed on unit 110 by securing such items to the frame of unit 110 or any of the panels secured to unit 110.

Lighting or ventilation can be housed in the open space within the frame of unit 110 (not shown). Panels with appropriate openings may need to be used in such a case.

Unit 110 can be composed of any lightweight hard material such as aluminum, plastic, wood, or any combination thereof.

Second Frame

In another embodiment, apparatus 100 can include a second frame (not shown) coupled to the side of frame 200 opposite the wall frame 200 abuts. This second frame is about the same size and shape as frame 200. Coupling the second frame to frame 200 expands the size of apparatus 100. In such a configuration, unit 102 will need to have additional length in order to fit over the top of both frames and the side of the second frame.

In a similar manner to that of frame 200, the second frame can have a front fascia coupled to its front and a frame-shelving unit coupled to its rear (not shown).

The second frame can be composed of any lightweight hard material such as aluminum, plastic, wood, or any combination thereof.

U-Shaped Unit

Figure 12:
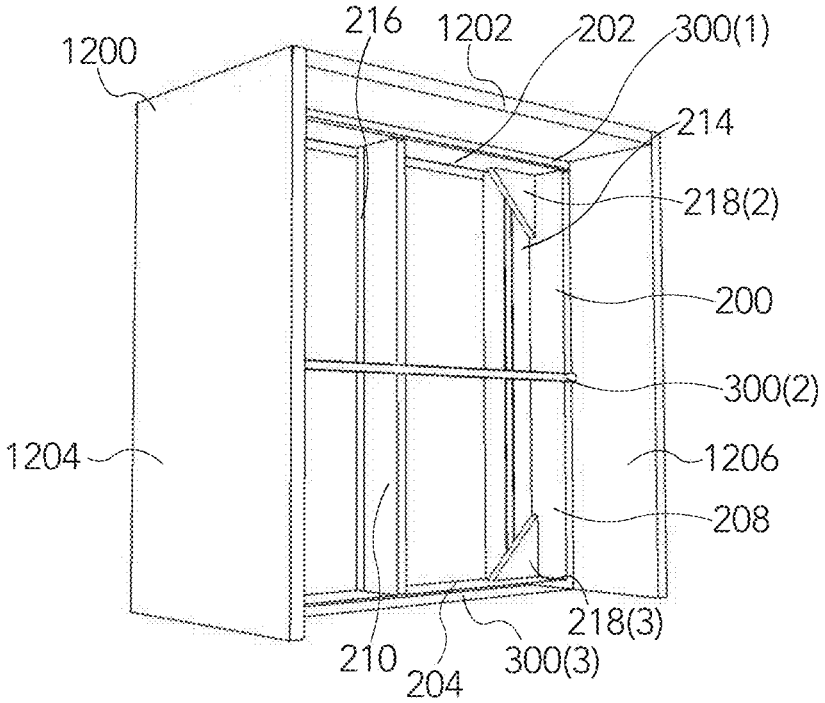
FIG. 12 shows a bottom front perspective view of a frame and U-shaped unit from an embodiment of a modular home bar apparatus.

In another embodiment, a homeowner can install frame 200 as a floating unit in a room (not shown). In which case, unit 102 is replaced with a U-shaped unit 1180 as shown in FIG. 12. Unit 1180 has a top panel 1182 configured to fit coextensively along beam 202, a left side panel 1184 configured at about a ninety-degree angle from panel 1182 that fits coextensively along beam 206, and a right side panel 1186 also configured at about a ninety-degree angle from panel 1182 that fits coextensively along beam 208. The ends of panel 1184 and panel 1186 opposite panel 1182 abut the floor. The dimensions of panel 1182 are about equal to that of panel 112. The dimensions of panel 1184 and 1186 are about equal to that of panel 114.

When installed as a floating unit, frame 200 can be secured to the floor, but not a wall. Unit 1180 can be secured to the top and sides of frame 200 by various means including but not limited to nuts and bolts, butterfly locks, magnets, or any combination thereof.

Unit 1180 can be composed of any lightweight hard material such as aluminum, plastic, wood, or any combination thereof. It can also have a water resistant or waterproof coating allowing for easy cleaning of unit 1180.

Operation

Apparatus 100 allows a homeowner to have the advantages of a home bar without the hassle of professional installation. All of the components of apparatus 100 are modular. This means that there are only a few pieces necessary for home installation. This makes it possible for a homeowner to install apparatus 100 without the assistance of a professional contractor even when the components are made of heavy materials like solid wood. Also, because apparatus 100 is secured to a wall or floor at only a few points, removing apparatus 100 is easier than removing a traditional home bar.

The depth of the part of frame 200 that rests on the floor is small compared to the rest of frame 200, five and a half inches of distance C compared to three and a half feet of distance A. This means that frame 200 would be fairly unstable if installed alone. Distance D, however, is more than three times that of distance C, which means that the depth of unit 102 is more than three times that of frame 200. The combination of frame 200 with unit 102 provides an added effective footprint that makes apparatus 100 much more stable than if frame 200 were installed alone and possibly more stable than other modular home bars.

The modular design of apparatus 100 makes it customizable. All of the components can be readily changed, which allows a homeowner to easily make subsequent modifications to apparatus 100.

Apparatus 100 can act as a wet bar or a dry bar depending on the other implements placed in the bar by the user (not shown).

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A modular home bar apparatus, comprising:

a frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams each have a given depth where each depth is approximately equal;

an L-shaped unit configured to mount and fit coextensively over the frame structure, wherein the L-shaped unit, includes a vertical-side panel, and a top-horizontal panel, wherein the vertical-side panel, and the top-horizontal panel are joined perpendicularly to each other forming a corner;

wherein the top-horizontal panel is disposed on top of the horizontal-top beam, and wherein the vertical-side panel of the L-shaped unit is disposed over at least one of the vertical-side beams;

wherein the top-horizontal panel extends beyond and overlies the top surface of the horizontal-top beam, and wherein the vertical-side panel extends over and beyond the side surface of the vertical-side beam where the vertical-side panel has a depth of about three times that of the depth of the vertical-side beam; and wherein a distal edge of the top-horizontal panel opposite the corner is configured to abut a wall, and wherein a distal edge of the vertical-side panel opposite the corner is configured to rest upon a ground surface of a floor, whereby the L-shaped unit is configured to provide stability for the frame structure.

2. The apparatus of claim 1, wherein the frame structure further includes a vertical-central beam parallel to the vertical-side beams attached at distal ends to the horizontal-top beam and the bottom beam, wherein the vertical-central beam is located at the midpoint between the vertical-side beams and has the same depth as the vertical-side beams; and three vertical-support beams located in the plane perpendicular to both the horizontal-top beam and the vertical-side beams, attached at distal ends to the horizontal-top beam and the bottom beam, wherein an edge of the first vertical-support is attached to an edge of one of the vertical-side beams, an edge of the second vertical-support is attached to an edge of the other vertical-side beam, and an edge of the third vertical-support is attached to an edge of the vertical-central beam.

3. The apparatus of claim 1, wherein the frame structure further includes at least one horizontal-front beam parallel to the horizontal-top beam attached at distal ends to the vertical-side beams, wherein the horizontal-front beams are located on a plane perpendicular to the horizontal-top beam and the vertical-side beams.

4. The apparatus of claim 1, wherein the frame structure further includes a front fascia coupled between the two vertical-side beams in perpendicular relationship to the ground surface.

5. The apparatus of claim 1, further comprising a shelving unit coupled to the frame structure.

6. The apparatus of claim 1, further comprising a shelving unit for attachment to a wall.

7. The apparatus of claim 1, further comprising a second frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams have about the same depth, is attached to the ceiling above the frame structure, wherein bar accessories are attached to the second frame structure or lighting or ventilation is placed within the open space of the second frame structure.

8. The apparatus of claim 1, wherein a second frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams have about the same depth is attached to a vertical-side beam of the frame structure and the L-shaped unit is configured to mount and fit coextensively over both frame structures and the side of the second frame structure.

9. A modular home bar apparatus, comprising:

a frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams each have a given depth where each depth is approximately equal;

a U-shaped unit configured to mount and fit coextensively over the frame structure, wherein the U-shaped structure, includes two opposing vertical-side panels, and a top-horizontal panel, wherein the vertical-side panels are joined perpendicularly to the top-horizontal panel at either end of the top-horizontal panel forming two corners; wherein the top-horizontal panel is disposed on top of the horizontal-top beam, and wherein the vertical-side panels of the U-shaped unit are disposed over the vertical-side beams; wherein the top-horizontal panel extends beyond and overlies the top surface of horizontal-top beam, and wherein the vertical-side panels extend over and beyond the side surfaces of the vertical-side beams where the vertical-side panels each have a depth of about three times that of the depth of the vertical-side beams; and wherein the distal edges of the vertical-side panels opposite the top-horizontal panel are configured to rest upon a ground surface of a floor, whereby the U-shaped unit is configured to provide stability for the frame structure.

10. The apparatus of claim 9, wherein the frame structure further includes a vertical-central beam parallel to the vertical-side beams attached at distal ends to the horizontal-top beam and the bottom beam, wherein the vertical-central beam is located at the midpoint between the vertical-side beams and has the same depth as the vertical-side beams; and three vertical-support beams located in the plane perpendicular to both the horizontal-top beam and the vertical-side beams, attached at distal ends to the horizontal-top beam and the bottom beam, wherein an edge of the first vertical-support is attached to an edge of one of the vertical-side beams, an edge of the second vertical-support is attached to an edge of the other vertical-side beam, and an edge of the third vertical-support is attached to an edge of the vertical-central beam.

11. The apparatus of claim 9, wherein the frame structure further includes at least one horizontal-front beam parallel to the horizontal-top beam attached at distal ends to the vertical-side beams, wherein the horizontal-front beams are located on a plane perpendicular to the horizontal-top beam and the vertical-side beams.

12. The apparatus of claim 9, wherein the frame structure further includes a front fascia coupled between the two vertical-side beams in perpendicular relationship to the ground surface.

13. The apparatus of claim 9, further comprising a shelving unit coupled to the frame structure.

14. The apparatus of claim 9, further comprising a shelving unit for attachment to a wall.

15. The apparatus of claim 9, further comprising a second frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams have about the same depth, is attached to the ceiling above the frame structure, wherein bar accessories are secured to the second frame structure or lighting or ventilation is secured to the second frame structure within the open space of the second frame structure.

16. The apparatus of claim 9, wherein a second frame structure, having a horizontal-top beam with a top surface, an opposing bottom beam, and two opposing vertical-side beams attached to the horizontal-top beam and the bottom beam at distal ends of the horizontal-top beam and the bottom beam forming a square, wherein the vertical-side beams each have a side surface and the horizontal-top beam, bottom beam, and two vertical-side beams have about the same depth, is attached to a vertical-side beam of the frame structure and the U-shaped unit is configured to mount and fit coextensively over both frame structures, a side of the frame structure, and a side of the second frame structure.

* * * * *